US011312597B2

(12) United States Patent
Hasler

(10) Patent No.: US 11,312,597 B2
(45) Date of Patent: Apr. 26, 2022

(54) GRIPPING DEVICE FOR SHELLS

(71) Applicant: NEXTER SYSTEMS, Roanne (FR)

(72) Inventor: Jean Luc Hasler, Bourges (FR)

(73) Assignee: NEXTER SYSTEMS, Roanne (FR)

( * ) Notice: Subject to any disclaimer, the term of this patent is extended or adjusted under 35 U.S.C. 154(b) by 96 days.

(21) Appl. No.: 16/755,867

(22) PCT Filed: Sep. 28, 2018

(86) PCT No.: PCT/EP2018/076540
§ 371 (c)(1),
(2) Date: Apr. 13, 2020

(87) PCT Pub. No.: WO2019/072600
PCT Pub. Date: Apr. 18, 2019

(65) Prior Publication Data

US 2021/0198085 A1 Jul. 1, 2021

(30) Foreign Application Priority Data

Oct. 12, 2017 (FR) ..... 1701067

(51) Int. Cl.
*B66C 1/42* (2006.01)
*F41A 9/87* (2006.01)

(52) U.S. Cl.
CPC ..... *B66C 1/422* (2013.01); *F41A 9/87* (2013.01)

(58) Field of Classification Search
CPC .. B66C 1/22; B66C 1/42; B66C 1/422; B66C 1/64; B66C 1/108; B25J 15/022; F41A 9/87; F41A 99/00
See application file for complete search history.

(56) References Cited

U.S. PATENT DOCUMENTS 1,396,328 A * 11/1921 Hall ..... B66C 1/422 294/15
2,365,930 A * 12/1944 Bayhi ..... B66C 1/42 294/87.1

(Continued)

FOREIGN PATENT DOCUMENTS

EP 0463913 A1 * 1/1992 ..... B23P 19/001
FR 2720226 A1 * 12/1995 ..... A01K 97/14

(Continued)

OTHER PUBLICATIONS

Jun. 22, 2018 Search Report issued in French Patent Application No. 1701067.

(Continued)

*Primary Examiner* — Saul Rodriguez
*Assistant Examiner* — Joseph Aronson
(74) *Attorney, Agent, or Firm* — Oliff PLC

(57) ABSTRACT

A gripping device for shells that includes a pair of jaws intended to clamp a shell, each jaw being able to pivot towards a closed position obtained by applying the top end of each jaw to the shell. A locking means links the top ends of the jaws and includes two connecting rods and a central segment linking these connecting rods. The connecting rods are articulated relative to the jaws by a first articulation and by a second articulation to the central segment. A spring links each first articulation to a central point of the segment. A movable stop situated above the locking means is capable of pushing the locking means downwards until it is below an unstable equilibrium position of the locking means.

6 Claims, 5 Drawing Sheets

(56) References Cited

U.S. PATENT DOCUMENTS

| | | | | | |
|---|---|---|---|---|---|
| 2,610,890 | A * | 9/1952 | Jaeger | B66C 1/32 | 294/111 |
| 5,163,727 | A * | 11/1992 | Slezak | B66C 1/422 | 294/81.4 |
| 5,486,030 | A * | 1/1996 | Cobelo | B65B 21/12 | 294/201 |
| 6,012,752 | A * | 1/2000 | Douglas | B66C 1/422 | 294/119 |
| 8,973,960 | B2 * | 3/2015 | Wehrly | E02F 3/02 | 294/204 |

FOREIGN PATENT DOCUMENTS

| | | | | |
|---|---|---|---|---|
| FR | 2 769 302 | A1 | 4/1999 | |
| FR | 2769302 | A1 * | 4/1999 | B65G 7/12 |
| FR | 3 041 622 | A1 | 3/2017 | |
| FR | 3041622 | A1 * | 3/2017 | B66C 1/422 |
| KR | 200196267 | Y1 * | 9/2000 | |

OTHER PUBLICATIONS

Jun. 22, 2018 Written Opinion issued in French Patent Application No. 1701067.

Jan. 15, 2019 International Search Report issued in International Patent Application No. PCT/EP2018/076540.

Jan. 15, 2019 Written Opinion of the International Searching Authority issued in International Patent Application No. PCT/EP2018/076540.

* cited by examiner

GRIPPING DEVICE FOR SHELLS

The technical field of the invention is that of gripping devices for shells, and in particular for large-caliber shells.

In order to handle large-caliber shells (diameter greater than 80 millimeters) simply and quickly, it is known from patent FR 3,041,622 to use a shell clamp including a pair of jaws intended to clamp a shell, each jaw pivoting between an open position and a closed position about a pivot pin parallel to the longitudinal axis of the shell, the pivot pin of each jaw being located between a lower end and an upper end of the jaw, the upper end of each jaw making it possible to close the jaw by bearing of this upper end on a shell to be grasped.

According to this patent, the upper end of each jaw includes a notch intended to interfere with a lug of a cam in order to keep the jaws in the closed position.

The closed position of the jaws is therefore directly related to the relative geometries of the cam and the jaw.

The cam is secured to a pivoting paddle, the pivoting of which, which is caused by the bearing on a zone close to a stretcher, makes it possible to rotate the cam and thus free the lug from the rotating path of the notch of the jaw, which results in freeing the opening of the jaw.

According to this patent, the gripping of a shell is done at its base on the one hand and at its warhead on the other hand. The geometries of the jaws and their cam are therefore defined as a function of the dimensions of these parts of the shell.

If one wishes to handle shells of different types and therefore different lengths, the geometries of the jaws will not be adapted and therefore the gripping will be poor, which risks causing accidents.

The invention proposes a single device for handling shells of variable lengths and ensures safer gripping of the transported shell.

The invention relates to a gripping device for shells, including at least one pair of jaws intended to clamp a shell, each jaw being able to pivot between an open position and a closed position about a pivot pin parallel to the longitudinal axis of the shell, the pivot pin of each jaw being secured to a frame and located between a lower end and an upper end of the jaw, the application of the upper end of each jaw on the shell causing the closing of the jaws, the device being characterized in that it includes a locking means linking the upper ends of the jaws and comprising two connecting rods and a central segment linking these connecting rods, the connecting rods being articulated relative to the jaws by a first articulation and articulated by a second articulation to the central segment, an elastic return means linking each first articulation at a so-called central point positioned in the middle of the central segment, the device including at least one movable stop secured to a maneuvering lever, the stop being located above the locking means and able to push the locking means downward until it is below an unstable equilibrium position of the locking means.

Advantageously, the device includes at least two pairs of coaxial jaws.

Advantageously, the device includes two stops each including a lever, each stop being intended to bear on one of the connecting rods of the locking means.

Advantageously, the frame includes a sliding bearing intended to interfere with an upper part of the shell in order to wedge the shell in the device.

Advantageously, the device includes at least one shim in its rear part that is intended to bear on a rear face of the base of the shell in order to position the latter longitudinally relative to the device.

Advantageously, each lever may be secured to two stops, each stop being intended to act on a connecting rod associated with a different pair of jaws.

The invention will be better understood upon reading the following description, the description being done in light of the appended drawings, in which drawings.

Figure 3A:
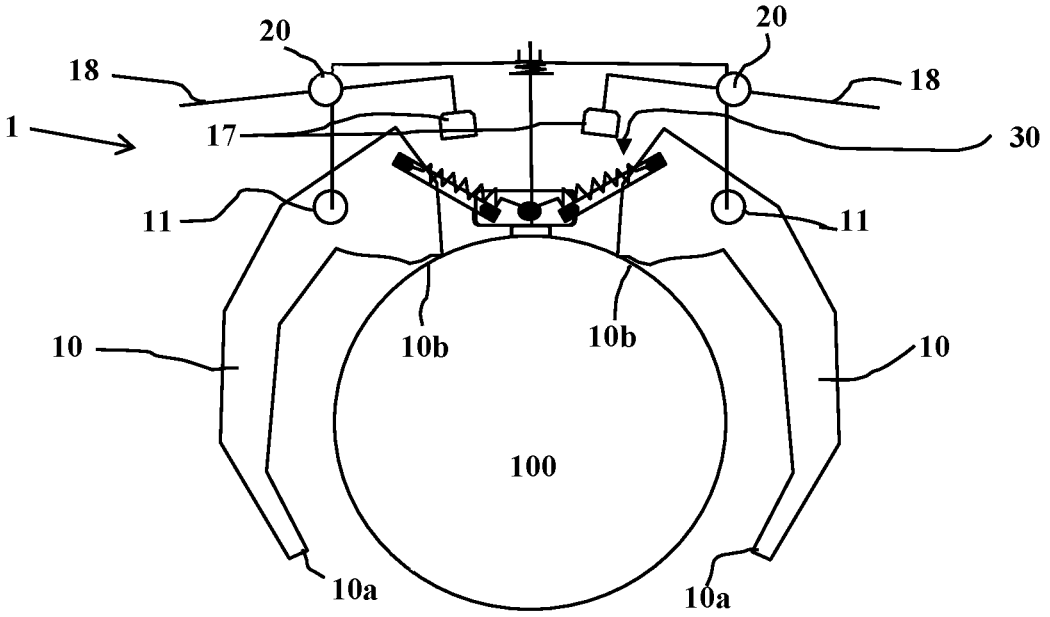
Figure 3B:
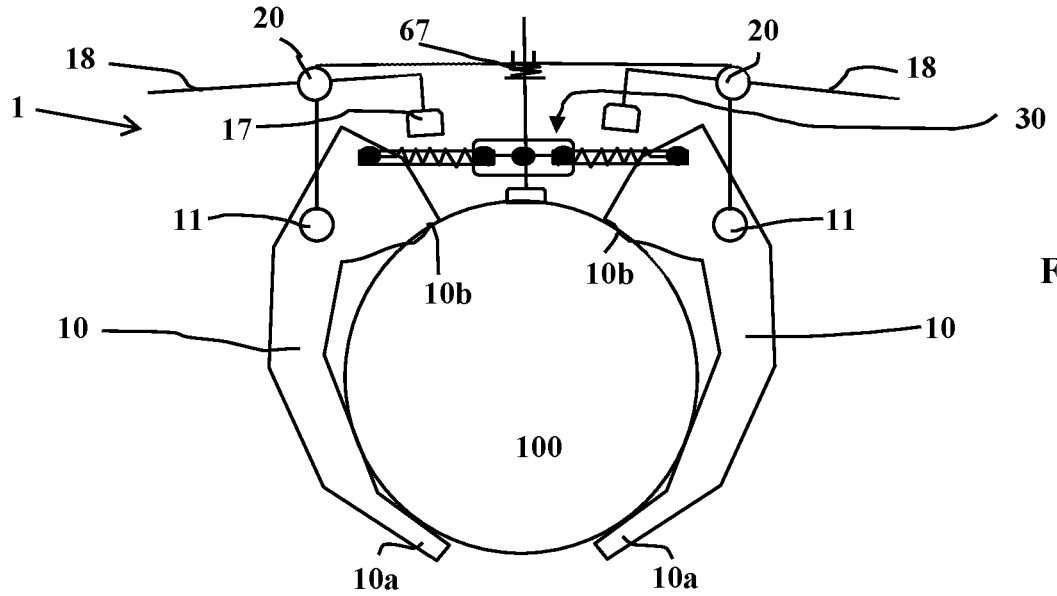
Figure 3C:
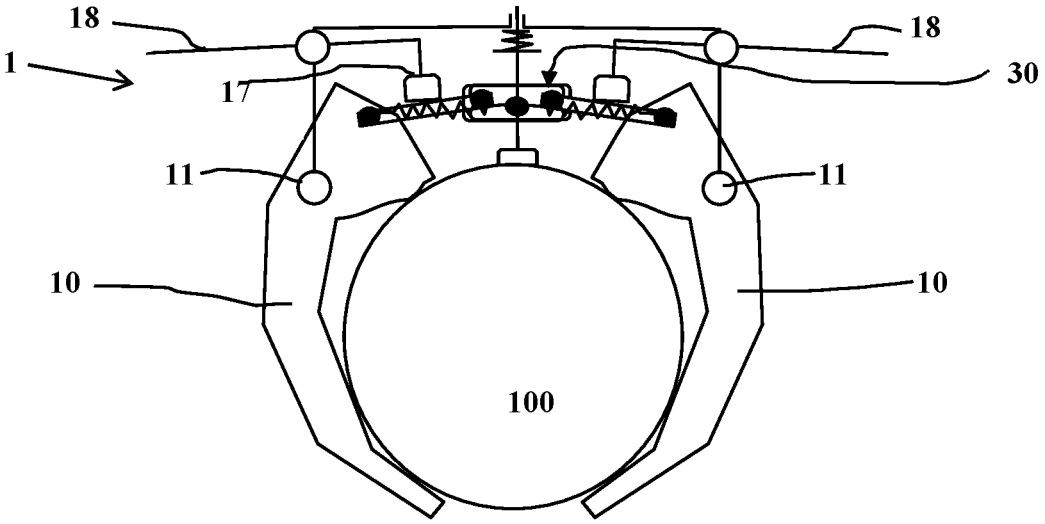

FIGS. 3*a*, 3*b* and 3*c* shows schematic views of a device according to the invention during three successive steps of gripping a shell.

Figure 4A:
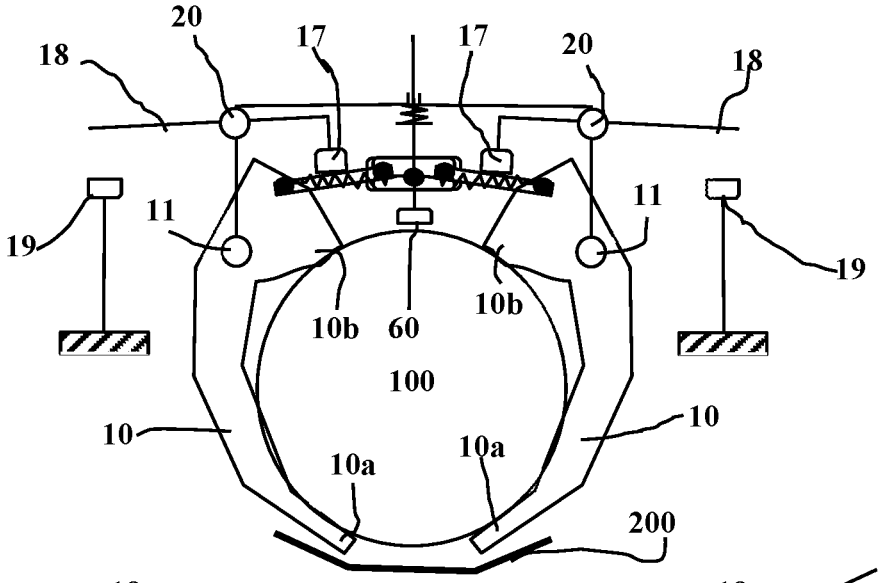
Figure 4B:
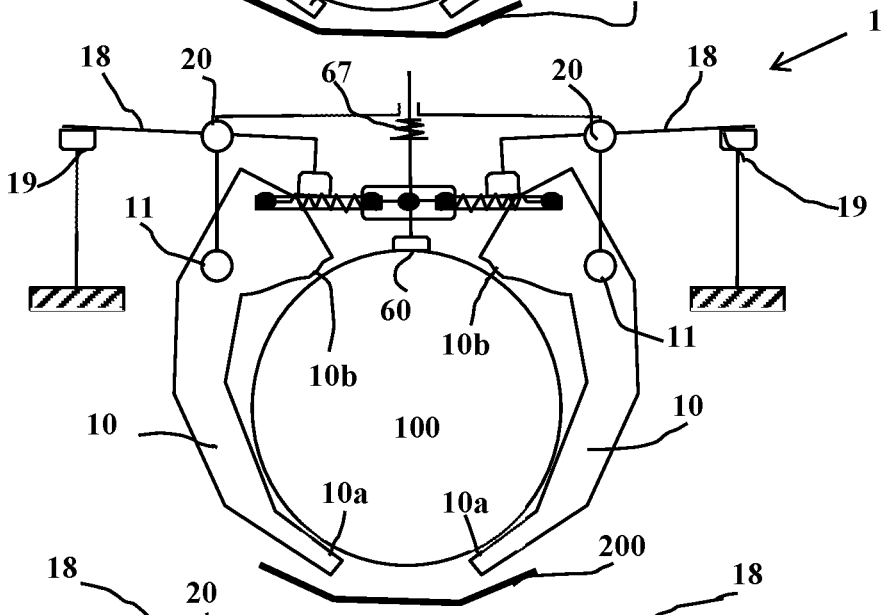
Figure 4C:
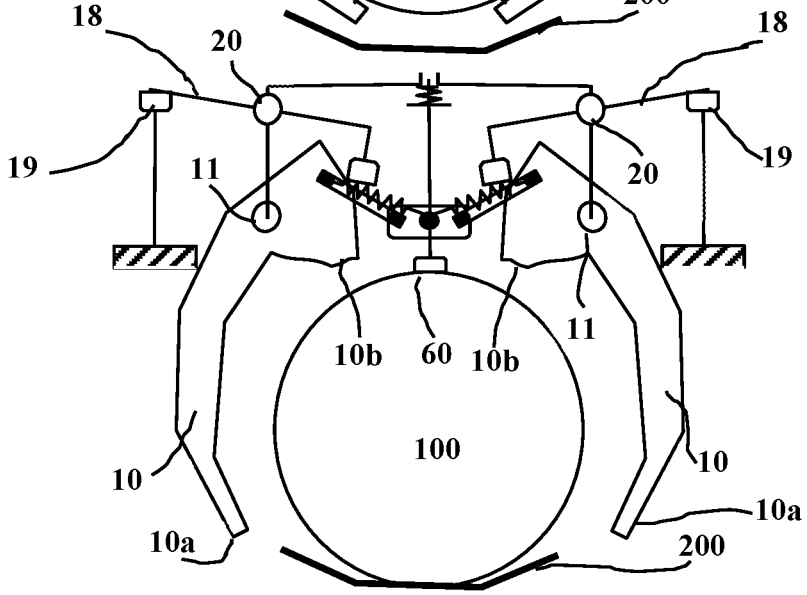

FIGS. 4*a*, 4*b* and 4*c* shows schematic views of a device according to the invention during three successive steps of releasing a shell.

Figure 5A:
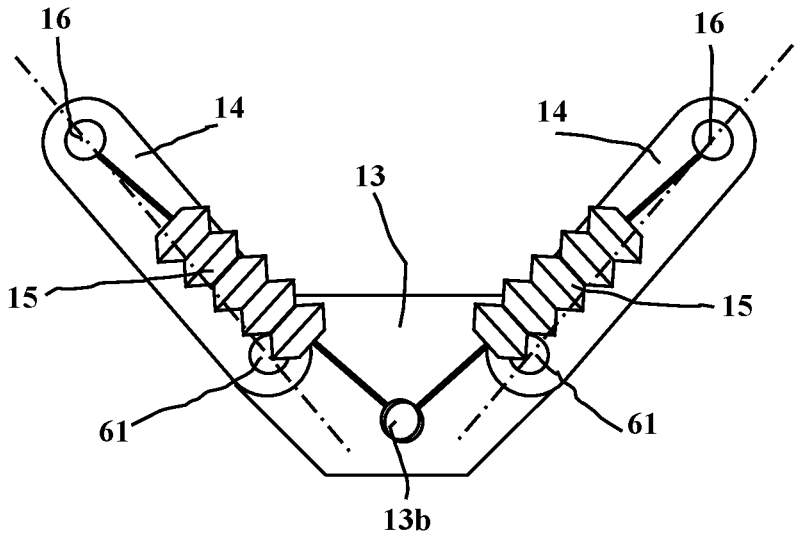
Figure 5B:
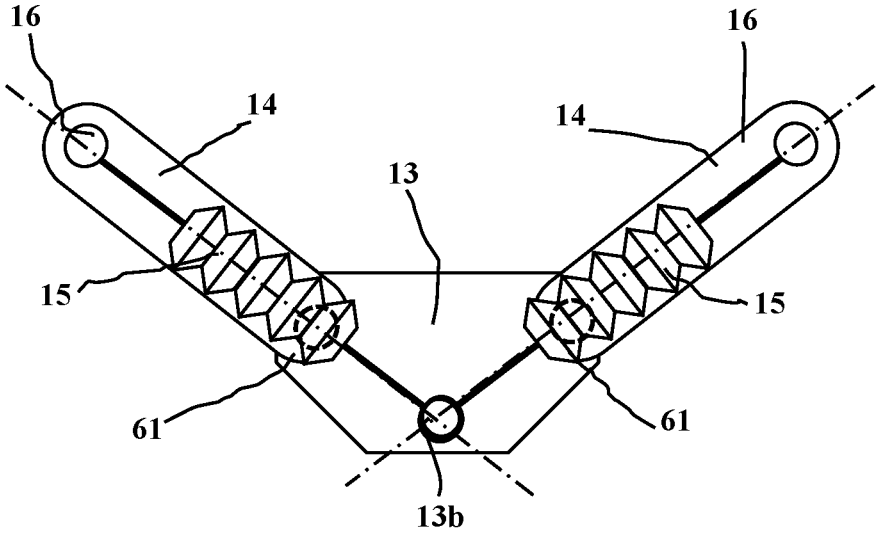
Figure 5C:
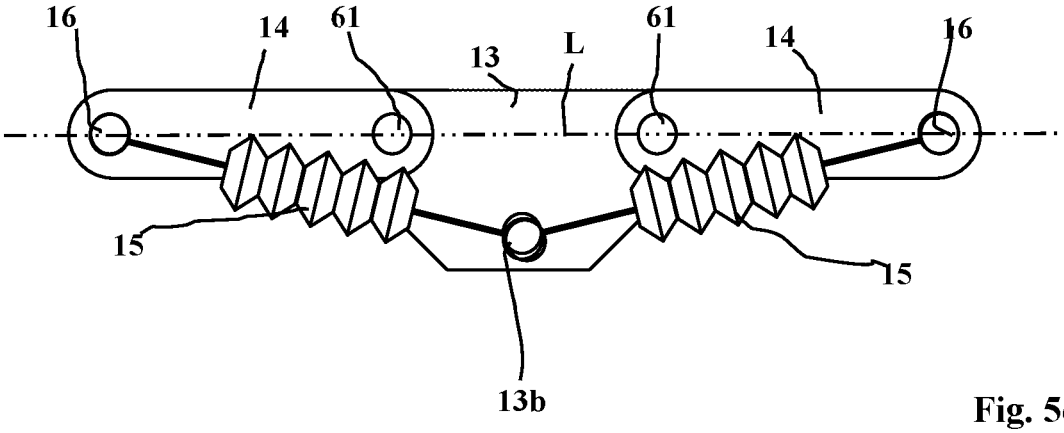

FIGS. 5*a*, 5*b* and 5*c* show schematic detail views of a locking means equipping a device according to the invention during the closing of the jaws of the device.

Figure 1:
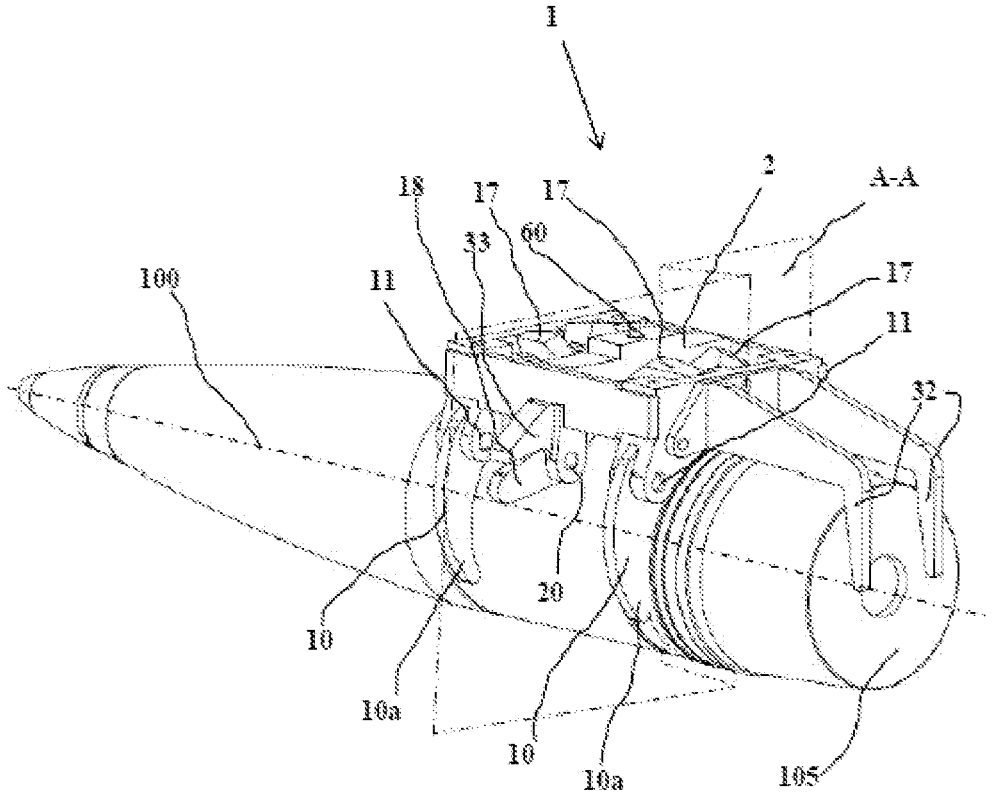
FIG. 1 shows a three-quarters perspective view of a device according to the invention containing a shell.

According to FIG. 1, a shell gripping device 1 intended to be attached to the end of a manipulating arm (arm not shown) includes a frame 2 that includes two pairs of jaws 10. Each pair of jaws 10 is intended to clamp a shell 100 at a cylindrical portion of its body. Each jaw 10 is mounted pivoting between an open position and a closed position owing to a pivot pin 11 located between the lower end 10*a* and an upper end of the jaw 10.

Figure 2:
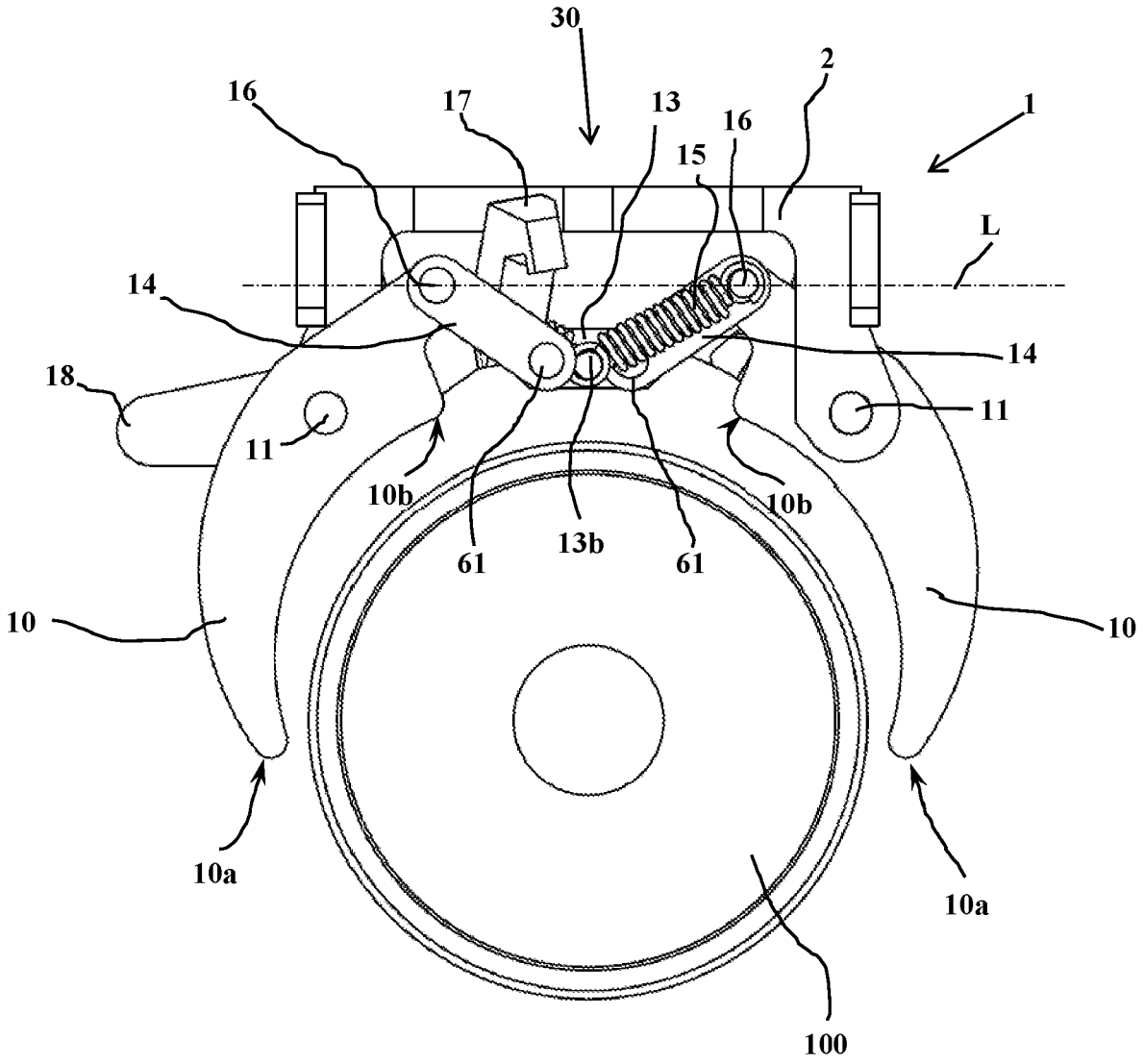
FIG. 2 shows a partial cross-sectional view along the offset parallel section plane A-A shown in FIG. 1.

As shown in FIG. 2, the upper ends 10*b* of the jaws 10 are linked to one another by pairs by a locking means 30.

This locking means 30, detailed in FIGS. 5*a*, 5*b*, 5*c*, includes a central segment 13, each of the ends of which carries a connecting rod 14 that is coupled to an upper end 10*b* of a jaw 10.

The connecting rods 14 are articulated relative to the jaws 10 at first articulations 16 and relative to the central segment 13 at second articulations 61.

It will be noted that FIG. 2 is a sectional view along two parallel planes. Thus:

- the left part of FIG. 2 shows the device cut at the pin 11 of the jaw located toward the rear of the shell and behind this jaw 10, which makes it possible to view a connecting rod 14;
- the right part of FIG. 2 shows the device cut behind the part of the frame 2 supporting the pin 11 of the jaw 10 located in front of the shell, which makes it possible to view a tension spring 15 and its central attachment point 13*b*.

Elastic return means 15, in the case at hand tension springs 15, link the first articulations 16 to a point, called central point 13*b*, of the central segment 13. This central point 13*b* is located longitudinally in the middle of the central segment 13, below a horizontal line L passing through each of the articulations 16 and 61 when the connecting rods 14 are aligned as in FIG. 5*c*.

Thus, according to FIGS. 3*a* to 3*c*, in order to grasp a shell 100, the device 1 is lowered onto the shell 100 with the jaws 10 in the open position. The upper end 10*b* of each jaw 10 is placed bearing on the shell 100.

In this position, the locking means 30 is in the configuration shown in FIG. 5*a*. The springs 15 exert a force that tends to bring the first articulations 16 closer to the central point 13*b* and thus to move the second articulation 61 downward, which opens the jaws 10 and keeps them in this open position.

According to FIG. 3*b*, the bearing and the lowering of the device 1 on the shell 100 causes the pivoting of the jaws 10 about their pins 11 toward the closed position and the clamping of the shell 100. During this phase, the upper ends 10*b* of the jaws 10 move away from one another.

The locking device 30 goes through an unstable equilibrium position illustrated in FIG. 5*b* where the first 16 and second 61 articulations of each connecting rod 14 align with the central point 13*b*. Each line linking a first articulation 16 and a second articulation 61 is parallel to the tension force of the spring 15 in question, which constitutes an unstable position for the locking means 30. In this position, the tension force supplied by each spring is at its maximum.

By continuing the closing movement of the jaws 10, the connecting rods 14 will gradually rotate until they align (FIG. 5*c*). As previously mentioned, it is noted that once the connecting rods 10 are aligned, the central point 13*b* of the central segment 13 is located below a horizontal line L passing through each of the articulations 16 and 61, which makes it possible to force the crossing of the unstable equilibrium position by the second articulations 61. The jaws 10 are then in their most closed position. Once the unstable equilibrium position of FIG. 5*b* has been passed, the springs 15 result in bringing the connecting rods 14 closer to position 5*c*, which corresponds to maximal closure of the jaws 10.

In order to stop the movement of the connecting rods 14, a stop 17 placed above the locking means 30 (also visible in FIG. 2) blocks the rising of the second articulations 61 by interfering with the connecting rods 14 or the central segment 13.

The shell 100 is then blocked by the jaws 10 as visible in FIG. 3*c*.

In order to release the shell 100, the device 1 is brought above a stretcher 200 as in FIG. 4*a*. The stretcher is similar to that described by patent FR 3,041,622 and has, on either side, bearing elements 19 called buffers 19 that are intended to interfere with levers 18 of the device 1, pivoting relative to the frame 2 about pins 20 and secured to stops 17 (see also FIGS. 1 and 2).

By lowering the device 1 bearing the shell 100, like in FIG. 4*b*, the interference of the buffers 19 will cause the pivoting of the levers 18, which will push the stops 17 against the connecting rods 14 until the second articulations 61 pass below the unstable equilibrium position previously defined, which causes the rapid opening of the jaws 10 (driven by the springs 15), as visible in FIG. 4*c*, and the depositing of a shell 100 in the stretcher 200.

The jaws 10 are then locked in the open position by the simple tension action of the springs 15. The device 1 is ready to grasp a new shell.

One can therefore see that the device according to the invention can adapt to the holding of shells having substantially different sizes, the locking position being able to be obtained for different pivotings of jaws. The essential point is to pass the locking means 30 past its unstable equilibrium position. In this case, the springs 15 ensure the locking of the jaws. The stiffness of the springs 15 will be chosen to be sufficient to prevent, during vibrations, any return of the locking means 30 to the released position of the shell (FIG. 3*a*).

As shown in FIGS. 4*a* to 4*c*, the device 1 may include a sliding bearing 60 able to be pushed back by a spring 67 through the frame 2 and against the upper part of a shell in order to wedge it when it is grasped in the device 1 by application of a vertical force, to combat the accelerations on all of the axes.

In FIG. 1, it is noted that the frame 2 includes a pair of shims 32 intended to bear on a rear face of the base 105 of the shell 100 in order to position the shell 100 longitudinally relative to the device 1. The frame 2 also includes, on each side, flanging elements 33 (only one is visible in FIG. 1) that are intended to limit the pivoting of the levers 18 and therefore the downward travel of the associated stops 17. It will also be noted that according to the embodiment of FIG. 1, each lever 18 is secured to two stops 17 that are intended each to act on a locking means associated with a different pair of jaws. Thus, the levers 18 are located longitudinally midway from the pairs of jaws 10 (FIG. 1).

The invention claimed is:

1. A gripping device for shells, the gripping device comprising:

at least one pair of jaws intended to clamp a shell, each jaw being able to pivot between an open position and a closed position about a pivot pin parallel to a longitudinal axis of the shell, the pivot pin of each jaw being secured to a frame and located between a lower end and an upper end of the jaw, the application of the upper end of each jaw on the shell causing the closing of the jaws, wherein the device further includes a locking means linking the upper ends of the jaws and comprising two connecting rods and a central segment linking these connecting rods, the connecting rods being articulated relative to the jaws by a first articulation and articulated by a second articulation to the central segment, wherein an elastic return means links each first articulation at a central point positioned in the middle of the central segment, the device including at least one movable stop secured to a maneuvering lever, the stop being located above the locking means and able to push the locking means downward until the locking means is below an unstable equilibrium position of the locking means.

2. The gripping device according to claim 1, wherein the gripping device includes at least two pairs of coaxial jaws.

3. The gripping device according to claim 1, wherein the gripping device includes, for each pair of jaws of the at least one pair of jaws, two stops each secured to a lever, each stop being intended to bear on one of the connecting rods of the locking means.

4. The gripping device according to claim 1, wherein the frame includes a sliding bearing intended to interfere with an upper part of the shell in order to wedge the shell in the gripping device.

5. The gripping device according to claim 1, wherein the gripping device includes at least one shim in a rear part of the gripping device that is intended to bear on a rear face of the base of the shell in order to position the shell longitudinally relative to the gripping device.

6. The gripping device according to claim 3, wherein the gripping device includes two pairs of coaxial jaws, two stops associated with each pair of jaws, and two levers each secured to two stops associated with a different pair of jaws.

* * * * *